United States Patent [19]

Hildebrandt et al.

[11] 4,102,386

[45] Jul. 25, 1978

[54] CASTING APPARATUS

[75] Inventors: Peter Hildebrandt, Kranzberg; Georg Veranneman, Pullach; Werner Schottroff, Wolfratshausen, of Germany

[73] Assignee: Linde Aktiengesellschaft, Wiesbaden, Germany

[21] Appl. No.: 740,832

[22] Filed: Nov. 12, 1976

[30] Foreign Application Priority Data

Nov. 12, 1975 [DE] Fed. Rep. of Germany ..... 2550813
Mar. 19, 1976 [DE] Fed. Rep. of Germany ..... 2611831

[51] Int. Cl.[2] ..... B22D 21/02; B22D 23/00

[52] U.S. Cl. ..... 164/259; 164/415; 164/437; 164/66

[58] Field of Search ..... 164/66, 82, 259, 415, 164/437; 75/59, 60

[56] References Cited

U.S. PATENT DOCUMENTS

| | | | |
|---|---|---|---|
| 2,997,384 | 8/1961 | Feichtinger | 164/66 X |
| 3,125,440 | 3/1964 | Hornak et al. | 164/66 X |
| 3,439,735 | 4/1969 | Holmes | 164/259 |
| 3,451,594 | 6/1969 | Stewart | 164/66 X |
| 3,513,903 | 5/1970 | Suzuki et al. | 164/66 X |
| 3,908,734 | 9/1975 | Pollard | 164/259 X |

FOREIGN PATENT DOCUMENTS

| | | | |
|---|---|---|---|
| 228,418 | 7/1963 | Austria | 164/259 |
| 1,223,358 | 2/1960 | France | 164/66 |
| 396,166 | 1/1974 | U.S.S.R. | 164/259b |

OTHER PUBLICATIONS

Gas Shrouding of Strand Cast Steel at Jones and Loughlin Steel Corporation by N. L. Samways, B. R. Pollard and D. J. Fedenko, Journal of Metals, Oct. 1974, pp. 28–34.

*Primary Examiner*—Robert L. Spicer, Jr.
*Attorney, Agent, or Firm*—Karl F. Ross

[57] ABSTRACT

A casting apparatus in which a stream of molten metal is cast into a casting mold (e.g., an ingot mold) is provided along the stream with a porous refractory body to which supplied droplets of the metal do not adhere. A protective gas, usually nitrogen, is forced through the body to form a curtain or shield around the stream of the melt.

8 Claims, 4 Drawing Figures

CASTING APPARATUS

FIELD OF THE INVENTION

The present invention relates to a casting apparatus, and, more particularly, to improvements in such an apparatus designed, without difficulty, to protect the stream of casting metal from oxidation or the pickup of undesired gases.

BACKGROUND OF THE INVENTION

A casting apparatus generally comprises an upright casting mold into which the molten metal to be cast is poured from a ladle into the top. The melt forms a stream running from the outlet of the ladle to the body of the solidifying melt within the casting mold.

It is known to protect the casting stream, i.e., the stream of molten metal of a casting installation, before it enters the mold with an inert protective gas which is intended to form a sheath around the stream and thereby prevent oxidation of the molten metal and other undesirable gas takeup. The inert protective gas can be supplied in liquefied form or in gaseous form and generally is nitrogen.

Operating with liquefied nitrogen involves high apparatus costs since it is generally necessary to apply the liquiefied nitrogen directly, i.e., in its liquid state, to the melt.

In such systems, streams of liquefied nitrogen are trained against the casting stream and evaporated upon contact with the molten metal. This system has the disadvantage that the evaporation process produces a mist, cloud or the like which obscures observation of the stream of liquefied metal so that an optical evaluation of the progress of the casting process is not possible.

When gaseous nitrogen is supplied as the stream-surrounding blanket, the apparatus is simpler and less costly and the nitrogen consumption is reduced. However, the gas distributors used for forming the nitrogen blanket around the stream and generally comprised of tubes which completely enclose or surround the stream over its entire length in order to apply a uniform and continuous sheath or blanket of the protective gas. Such tubes, of course, also obscure the molten metal stream so as to prevent a visual determination of the progress of the casting process.

Both of these prior-art systems, moreover, have a common disadvantage in that spattered droplets from the molten metal stream become fixed to the gas or liquid distributors and eventually obscure the respective outlets on the sides of the distributors turned toward the molten stream. This of course has the disadvantage that it may interrupt the formation of the protective sheath of inert gas or cause partial disruption thereof with all of the drawbacks involved in the casting with an unprotected stream. Of course, when the surface of the distributor turned toward the molten metal stream is completely coated with droplets of the molten metal, all supply of the protective gas is terminated.

OBJECTS OF THE INVENTION

It is the principal object of the present invention to provide casting apparatus capable of effectively shielding the casting stream without the disadvantages enumerated earlier.

Still another object of this invention is to provide an improved device for protecting the casting stream of a casting apparatus.

Still another object of the invention is to provide an apparatus of the character described in which the means for forming the gas sheath surrounding the casting stream is less expensive and more reliable then heretofore, is more effective for longer periods than has hitherto been the case, and is free from the disadvantages of the earlier systems mentioned above.

SUMMARY OF THE INVENTION

These objects are attained, in accordance with the present invention, in a casting apparatus provided with a gas distributor for forming a sheath of inert gas, usually nitrogen, around the stream of molten material, wherein the gas distributor consists of a gas-permeable high temperature resistant material, namely, a porous refractory body to which spattered droplets of the casting-metal stream do not adhere.

The use of a gas permeable high temperature resistant material for fabricating the gas distributor, according to the invention, makes it possible to surround the casting stream with the protective gas without obscuring visual observation of the stream between the casting ladle and the casting mold and without reducing the space available for tapping the source of casting metal. These results obtain because of the present improvement eliminates completely the usual tubes for the protective gas which must surround the entire length of the casting stream to be effective and also eliminate the misting or clouding of the region between the casting stream and the observer. The inert gas, generally nitrogen, as indicated, can be drawn from a pressurized supply tank and forced under the pressure of this tank through the gas-permeable material to below, from the surface of the porous body, onto the casting stream.

According to an important feature of the invention, the gas-permeable body is constituted of a ceramic material which can be selected to prevent adhesion of spattered metal droplets thereto. This has the important advantage that the orifices, capillaries or pores of the body will not be obscured by the casting metal and thus over the entire life of the body provide a uniform distribution of the protective gas. While we provide, as noted below for a rapid replacement of the gas distributor when necessary, it is not essential that means be provided to permit such rapid replacement or removal since cleaning of the gas distributors is generally not frequently required.

It has been found that the best results are obtained when the ceramic material is burned clay in which, prior to burning, the clay mass is mixed with particles of a combustible material, the mass being then subjected to high temperature under oxidizing conditions sufficient to burn away the combustible particles and leave a network of pores in the hardened body. The firing can coincide with the decomposition of the particles which can be balls (microspheres) of foamable or foamed polystyrene. The burning of the particles produces gases which form in the clay mass a network of capillaries which increases the porosity of the clay. Depending upon the quantity of combustible particles added and their sizes, practically any desired gas throughput for a distributor of a particular size and for a particular gas pressure, can be obtained. The porous body may also be composed of other materials with similar characteristics, i.e., high temperature resistance, low adhesion of metal droplets and gas permeability. Of such other materials we prefer to use porous concrete.

According to another aspect of the invention, the gas distributor is constituted as a ring which can be disposed coaxially with the casting stream and can surround the latter spacedly over only a limited portion of the length of the casting stream. When the circularly cylindrical surface of the ring confronting the stream is gas permeable and the inert gas is forced into the porous body, the inert gas will distribute itself uniformly around the periphery of the stream, i.e., will form a protective gas layer uniformly on all sides thereof.

The gas distributor can, however, also be formed so that it only partly encloses the molten metal stream, e.g., as a half ring or, as is preferred in some cases, with two square porous blocks disposed at an angle to one another such as a molten metal stream runs between these blocks closed to the crotch or vertex of the assembly.

This open arrangement of the gas distributor of the present invention makes it possible, on the one hand, to tap the ladle or other vessel containing the melt without difficulty and also to protect the melt from the cold airstreams generally required in the vicinity of the casting apparatus for the conform and safety of the operating personnel. The V-section arrangement of the gas-distributing blocks thus also ensures that they will act as deflectors for the cooling airstreams to prevent contact of these streams with the melt.

The gas flow from the open gas divider does not run exclusively parallel to the casting-metal stream but also transversely thereto in the direction of the open side of the gas distributor. The transverse gas flow from each distributor block meets the transverse gas flow from the other between the casting metal stream and the mouth of the open distributor so as to form an inert gas curtain shielding the metal stream from cold airflows in the region of the casting apparatus.

According to a feature of the invention, the gas distributor of the present invention is disposed immediately adjacent the outlet or tap of the casting ladle, i.e., the point at which the cascade of molten metal leaves the ladle. In this region, especially when the gas distributor has one of the preferred configurations set forth above, an inert gas curtain is established around the metal stream immediately adjacent the outlet of the ladle to surround the stream with the inert gas. The molten metal stream has a strong ejector effect, i.e., gas-entrainment characteristic, so that the inert gas of this curtain is entrained along with the molten metal and drawn toward the molten metal at the point at which it emerges from the ladle and hence has its most active metal surface of greatest susceptibility to oxidation. The surface of the liquid metal is thus protected against oxidation and undesired gas takeup. When the gas distributor is a ring disposed immediately adjacent the tap of the ladle, it preferably has an axial length (measured along the metal stream) which is less than its diameter so that the gas distributor does not significantly prevent visual observation of the molten metal stream.

Of course, with the gas distributor of the invention, the velocity at which the inert gas emerges at the surface confronting the metal stream will be a function of the pressure of the gas fed to the distributor block. Preferably this pressure is so selected that the velocity of the protective gas is such that a laminar flow of the protective gas is entrained with and surrounds the casting-metal stream. Otherwise oxygen from the ambient atmosphere is turbulently entrained into the inert gas atmosphere and an effective shielding of the casting-metal stream is not obtained.

According to still another feature of the invention, the gas distributor is disposed immediately adjacent the inlet of the casting mold. Since protection of the stream of metal is desired above this mold as well, the inert gas velocity must be higher so that at least a portion of the gas flows in counterflow to the molten metal stream.

While the bulk of the inert gas curtain thus flows upwardly in counterflow to the molten metal stream, some of the inert gas at the boundary level between this curtain and the molten metal stream is entrained along with the stream in the opposite direction and flows parallel to the casting stream to provide a laminar curtain flowing codirectionally with the molten metal. This downwardly flowing boundary layer of gas again reaches the gas distributor at which it is caused to flow upwardly by the bulk of the upwardly flowing gas.

The molten metal stream is thus surrounded by a generally toroidal curtain which provides highly effective shielding of the casting metal stream.

To secure the gas distributor in place, more particularly, we have found it to be highly advantageous to make use of a Z-section metal body which, as seen in plan view, has a circular, semicircular or V-configuration and whose shanks meet each other at right angles. The shank turned toward the axis of the distributor can be provided with an abutment which engages the gas distributor while the shank turned away from the axis can be magnetically mounted upon a support, e.g., a metal plate affixed to the mold or the ladle or fixed between them and which is provided with a bore traversed by the casting metal stream.

Between the abutment formed by the shank turned toward the axis and the porous ceramic or otherwise refractory distributor body and the support bracket, there is formed a passage into which the inert gas is conducted by a supply duct, the gas passing under pressure through the gas permeable body.

Maintenance work on the gas distributor is here particularly simple since the magnetic attachment can be readily released to facilitate replacement or cleaning of the distributor and the other parts of the device.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
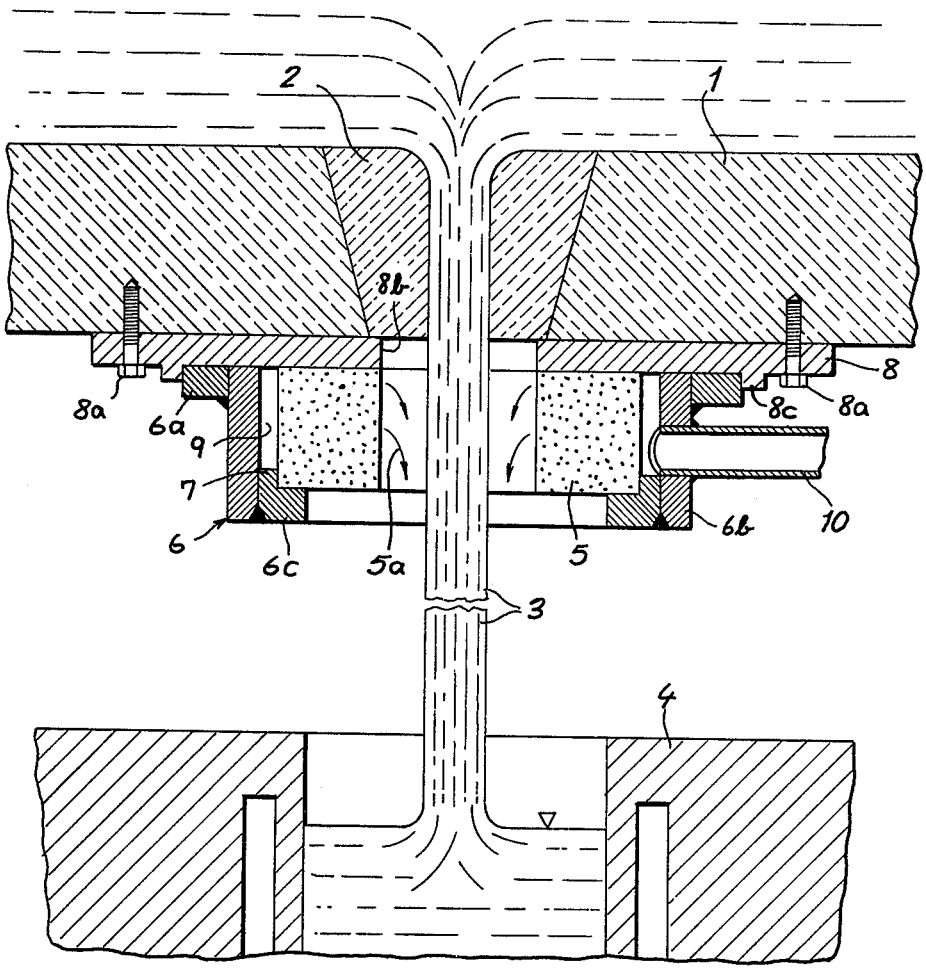
FIG. 1 is a diagrammatic vertical section through a portion of a casting apparatus embodying the invention.
Figure 4:
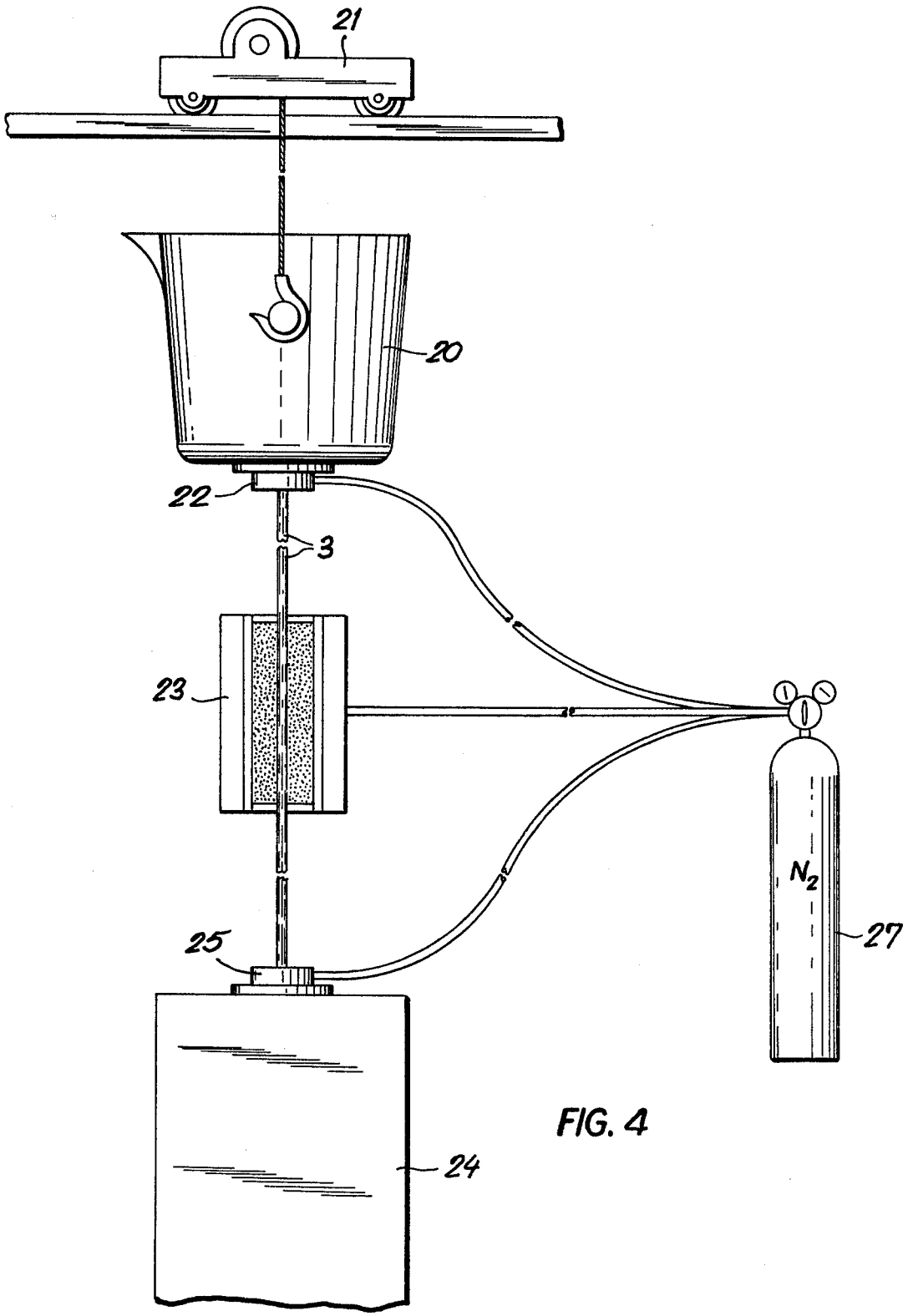
FIG. 4 is a diagrammatic elevational view illustrating an aspect of the invention.

Referring first to FIG. 4 it can be seen that an apparatus for casting can include a ladle 20 supported by the usual crane 21 and provided around its tap hole with a device 22 for producing an inert gas curtain and identical to the device shown in FIG. 1 for this purpose.

Figure 2:
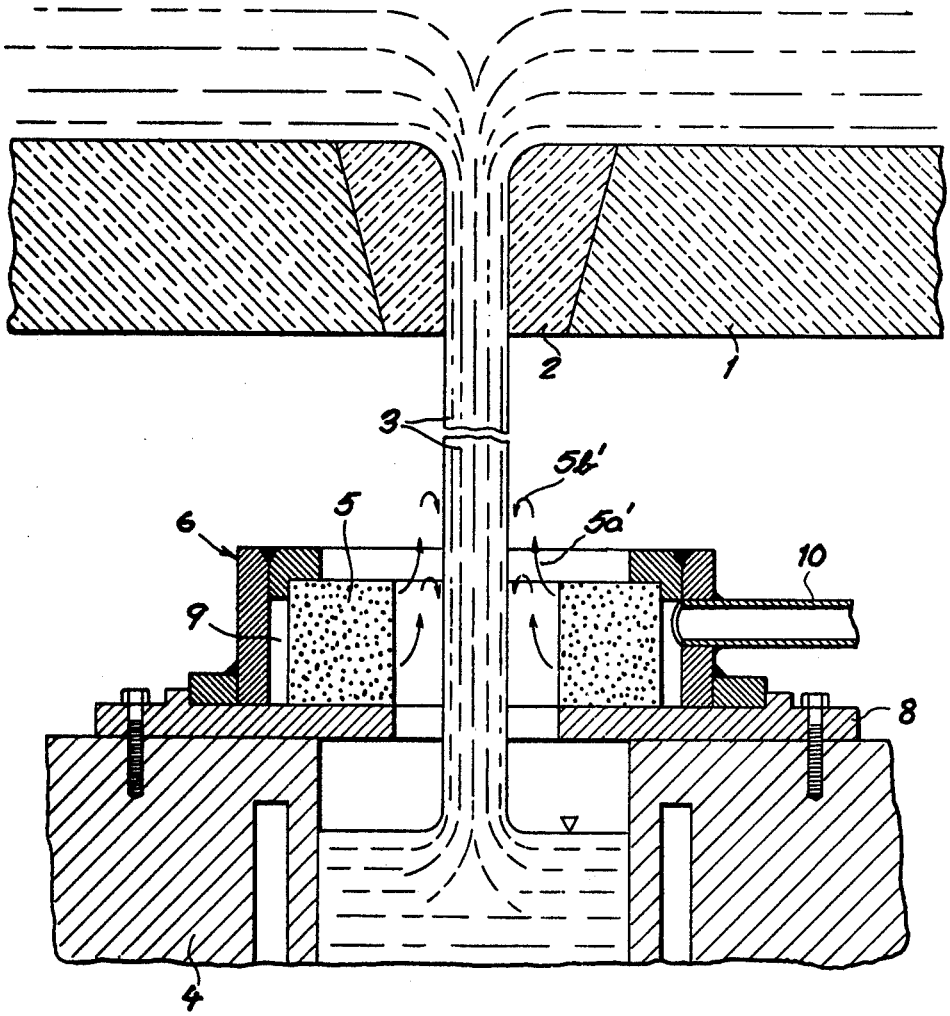
FIG. 2 is a section through a further embodiment of the invention.
Figure 3:
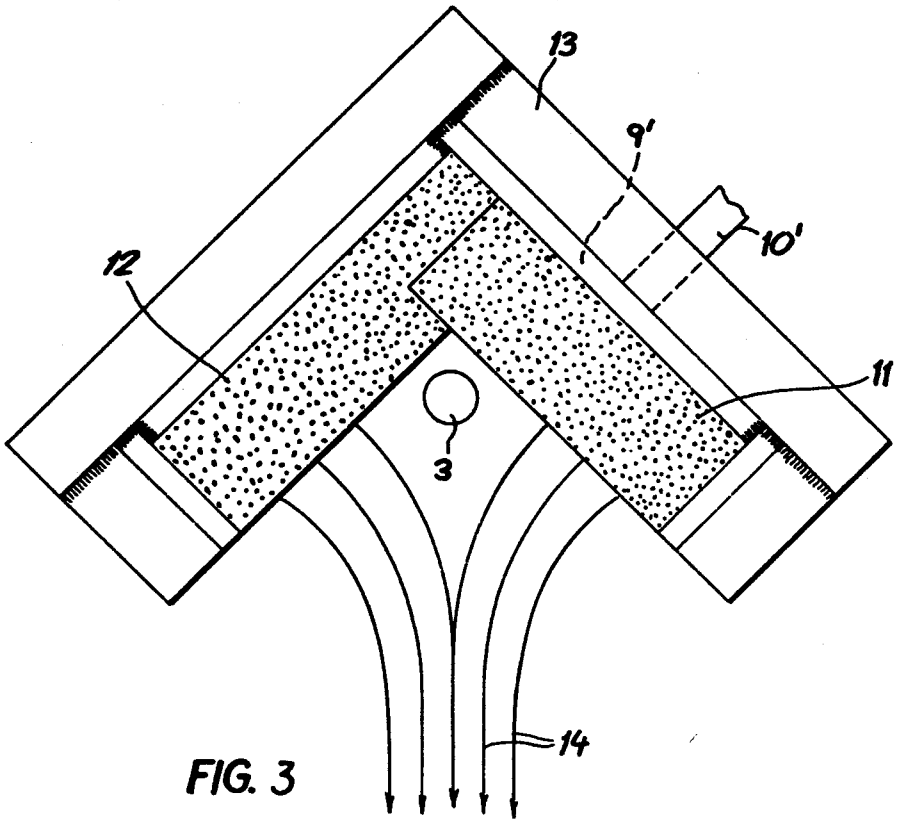
FIG. 3 is a horizontal section through still another embodiment of the invention.

For the most part, the casting metal stream 3 from this ladle is unobstructed and can pass over part of its length through the crotch of a device 23 similar to that shown in FIG. 3 for providing an inert gas curtain over at least a portion of the length of the stream. The stream then passes into a casting mold 24 which can be surmounted by a further device 25 identical to that shown in FIG. 2 to further shield the metal stream with inert gas.

In FIGS. 1 – 3 similarly functioning parts are designated by the same reference numeral although, where the parts are structurally different, they are distinguished from those of preceding Figures by primed numerals.

FIG. 1 shows a casting ladle 1 or a tundish (*The Making, Shaping And Treating of Steel,* U.S. Steel Corp., 1971, page 707 ff.) having an outlet 2 from which emerges a casting stream 3 of molten metal, the stream passing into a casting mold 4.

A metal plate 8 is affixed to the base of the ladle 1 by bolts 8*a* and has a central bore 8*b* which is aligned with the outlet 2 and coaxially receives the stream 3 of casting metal. The metal plate 8 is composed of a ferromagnetic material, e.g., iron or steel, to form a magnetically attractable support for the magnetic shank 6*a* of a Z-section metal bracket 6 which is secured by magnetic force to the plate 8 within a ridge 8*c* of the latter.

The shanks 6*a*, 6*b* and 6*c* of this bracket 6 extend at right angles to one another. The lower shank 6*c* extends toward the axis of the streams 3 and forms an abutment 7 which engages a gas-permeable refractory annular body 5 which is of cylindrical configuration, i.e., a ring so that a section through one half of the body parallel to the axis has the configuration of a rectangle. The body 5 can rest directly against the plate 8.

The shank 6*b* of the bracket 6 is spaced from the outer surface of the body 5 to define therewith an annular gap 9 forming a chamber which is supplied by a duct 10 with the protective gas from a supply tank, e.g., as shown at 27 in FIG. 4. The protective gas, usually nitrogen, is driven through the gas-permeable material of the body 5 by the pressure of the tank and passes into contact with and along the stream 3 as represented by the arrows 5*a*. Preferably a laminar flow of the inert gas along the stream 3 is maintained by controlling the pressure of the nitrogen.

In FIG. 2 we have shown a modified system in which the plate 8 is bolted to the mold 4 and thus has the Z-section bracket reversed by 180° from the configuration illustrated in FIG. 1. Otherwise the system of FIG. 2 is identical to that of FIG. 1 except that the protective gas flows upwardly as represented by the arrows 5*a*′ and thence downwardly as represented by the arrows 5*b*′.

FIG. 3, however, shows still another device in which the gas distributor consists of a pair of blocks 11 and 12 of gas-permeable, high-temperature resistant material seated in metal brackets 13 which have a Z-cross-section. The blocks 11 and 12 adjoin the right angles in a V-configuration so that the stream of molten metal 3, flowing perpendicular to the plane of the paper in FIG. 3, passes along the crotch of the V.

In this embodiment as well, gas is supplied, e.g., via a duct 10′ to a passage 9′ behind the block.

Arrows 14 show the flow of gas from individual pores of the block traversed to the molten-metal stream, these flows being in addition to the flows of inert gas which are entrained with the stream. The flows 14 meet at the open side of the distributor and thus prevent passage of air into contact with the molten-metal stream 3.

We claim:

1. In a casting apparatus having a source of molten casting metal provided with an outlet, a free-falling stream of molten casting metal flowing downwardly from said outlet, and a mold receiving said stream, the improvement which comprises:

a porous ring of high-temperature-resistant gas-permeable material disposed coaxially with said stream and extending over a minor portion of the length thereof, means for feeding said ring with a protective gas and forcing said gas through the pores thereof whereby said ring distributes protective gas emerging from the pores of said body all around said stream to shield the same from the ambient atmosphere over an unconfined portion of the length thereof, and means for connecting said ring directly with said source.

2. The improvement defined in claim 1 wherein said ring is composed of a ceramic material.

3. The improvement defined in claim 1 wherein said ring is composed of porous concrete.

4. In a casting apparatus having a source of molten casting metal provided with an outlet, a free-falling stream of molten casting metal flowing downwardly from said outlet, and a mold receiving said stream, the improvement which comprises:

a porous ring of high-temperature-resistant gas-permeable material disposed coaxially with said stream and extending over a minor portion of the length thereof, means for feeding said ring with a protective gas and forcing said gas through the pores thereof whereby said ring distributes protective gas emerging from the pores at said body all around said stream to shield the same from the ambient atmosphere over an unconfined portion of the length thereof, and means for connecting said ring directly with said source at said outlet, a porous body of said high-temperature-resistant gas permeable material being disposed along said stream and only partly surrounding same, said body being spaced from said ring, said body being connected with said means for feeding said ring with said protective gas whereby said protective gas is forced through said body for distribution around said stream at a location spaced from said ring.

5. The improvement defined in claim 1, further comprising a further porous ring of said high-temperature-resistant gas-permeable material disposed on said mold in the inlet of said stream thereto, and means connecting said further ring with said feeding means for feeding said protective gas through the pores of said further ring and distributing said protective gas all around said stream at said mold, the protective gas rising from said further ring along said stream.

6. The improvement defined in claim 1 wherein said ring constructed and arranged such that the gas distributed by said ring around said stream is entrained downwardly along said stream.

7. The improvement defined in claim 5, further comprising a Z-section bracket having shanks adjoining one another substantially at right angles, one of said shanks being turned toward said stream and forming an abutment for said further ring, said bracket defining a compartment with said further ring, and feeding means communicating with said compartment.

8. The improvement defined in claim 7 wherein another of said shanks is magnetically attractable and magnetically adheres to a metal plate supporting said bracket and said further ring on said mold.

* * * * *